United States Patent [19]

Wilson et al.

[11] Patent Number: 5,073,206

[45] **Date of Patent: * Dec. 17, 1991**

[54] METHOD OF CLEANING USING AZEOTROPE-LIKE COMPOSITIONS OF 1,1-DICHLORO-1-FLUOROETHANE, METHANOL AND NITROMETHANE

[75] Inventors: David P. Wilson; Ian R. Shankland, both of Williamsville; Earl A. E. Lund, West Seneca, all of N.Y.

[73] Assignee: Allied-Signal Inc., Morristown, N.Y.

[ * ] Notice: The portion of the term of this patent subsequent to Mar. 28, 2006 has been disclaimed.

[21] Appl. No.: 490,024

[22] Filed: Mar. 7, 1990

[51] Int. Cl.[5] ..... B08B 3/08; C11D 7/32; C11D 7/50

[52] U.S. Cl. ..... 134/40; 134/42; 252/171; 252/172; 252/305

[58] Field of Search ..... 134/43, 38, 22.019, 134/22.014, 40; 252/305, 171, 172

[56] References Cited

U.S. PATENT DOCUMENTS

| | | | |
|---|---|---|---|
| 3,340,199 | 9/1967 | Clay et al. | 252/171 |
| 3,607,755 | 9/1971 | Murphy | 252/305 |
| 4,330,422 | 5/1982 | Tesch | 252/305 |
| 4,816,174 | 3/1989 | Lund et al. | 134/171 |
| 4,842,764 | 6/1989 | Lund et al. | 252/171 |

*Primary Examiner*—Theodore Morris
*Assistant Examiner*—Saeed Chaudhry
*Attorney, Agent, or Firm*—Melanie L. Brown; Jay P. Friedenson

[57] ABSTRACT

A method of cleaning a solid surface is disclosed. The method involves spraying the solid surface with azeotrope-like compositions by using a propellant. The azeotrope-like compositions comprise from about 93.0 to about 98.0 weight percent 1,1-dichloro-1-fluoroethane, from about 7 to about 2 weight percent methanol, and from about 0.1 to about 0.01 weight percent nitromethane. Preferably, the propellant is selected from the group consisting of hydrocarbons, chlorofluorocarbons, hydrochlorofluorocarbon, hydrofluorocarbon, dimethyl ether, carbon dioxide, nitrogen, nitrous oxide, methylene oxide, air, and mixtures thereof.

8 Claims, No Drawings

METHOD OF CLEANING USING AZEOTROPE-LIKE COMPOSITIONS OF 1,1-DICHLORO-1-FLUOROETHANE, METHANOL AND NITROMETHANE

FIELD OF THE INVENTION

This invention relates to a method of cleaning using azeotrope-like mixtures of 1,1-dichloro-1-fluoroethane, methanol, and nitromethane.

CROSS-REFERENCE TO RELATED APPLICATIONS

Co-pending, commonly assigned U.S. patent application Ser. No. 345,732, filed 05/01/89, discloses azeotrope-like mixtures of 1,1-dichloro-1-fluoroethane; dichlorotrifluoroethane; nitromethane; and methanol or ethanol.

Co-pending, commonly assigned U.S. patent application Ser. No. 412,080, filed 09/25/89, discloses azeotrope-like compositions of 1,1-dichloro-1-fluoroethane; dichlorotrifluoroethane; methanol; and cyclopentane.

Co-Pending, commonly assigned U.S. patent application Ser. No. 417,134, filed 10/04/89, discloses azeotrope-like mixtures of 1,1-dichloro-1-fluoroethane; dichlorotrifluoroethane; and nitromethane.

Co-pending, commonly assigned U.S. patent application Ser. No. 423,993, filed 10/19/89, discloses azeotrope-like compositions of dichlorotrifluoroethane and methanol.

Co-pending, commonly assigned U.S. patent application Ser. No. 435,842, filed 11/10/89, discloses azeotrope-like compositions of 1,1-dichloro-1-fluoroethane; dichlorotrifluoroethane; and a mono- or di-chlorinated $C_2$ or $C_3$ alkane.

Co-pending, commonly assigned U.S. patent application Ser. No. 435,923, filed 11/10/89, discloses azeotrope-like compositions of 1,1-dichloro-1-fluoroethane; dichlorotrifluoroethane; methanol; and a mono- or dichlorinated $C_2$ or $C_3$ alkane.

Co-pending, commonly assigned U.S. patent application Ser. No. 453,449, filed 12/20/89, discloses azeotrope-like compositions of 1,1-dichloro-1-fluoroethane; dichlorotrifluoroethane; and methyl formate.

Co-pending, commonly assigned U.S. patent application Ser. No. 455,709, filed 12/22/89, discloses azeotrope-like compositions of 1,1-dichloro-1-fluoroethane; dichlorotrifluoroethane; and dichloromethane.

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancillary equipment.

Cold cleaning is another application where a number of solvents are used. In most cold cleaning applications the soiled part is either immersed in the fluid or wiped with rags or similar objects soaked in solvents and allowed to air dry.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

The art has looked towards azeotropic compositions including the desired fluorocarbon components such as trichlorotrifluoroethane which include components which contribute additionally desired characteristics, such as polar functionality, increased solvency power, and stabilizers. Azeotropic compositions are desired because they exhibit a minimum or maximum boiling point and do not fractionate upon boiling. This behavior is desirable because in the previously described vapor degreasing equipment with which these solvents are employed, redistilled material is generated for final rinse-cleaning. Thus, the vapor degreasing system acts as a still. Unless the solvent composition exhibits a constant boiling point, i.e., is an azeotrope or is azeotrope-like, fractionation will occur and undesirable solvent distribution may act to upset the cleaning and safety of processing. Preferential evaporation of the more volatile components of the solvent mixtures, which would be the case if they were not an azeotrope or azeotrope-like, would result in mixtures with changed compositions which may have less desirable properties, such as lower solvency towards soils, less inertness towards metal, plastic or elastomer components, and increased flammability and toxicity.

The art is continually seeking new fluorocarbon based azeotropic mixtures or azeotrope-like mixtures which offer alternatives for new and special applications for vapor degreasing and other cleaning applications. Currently, of particular interest, are such azeotrope-like mixtures which are based on fluorocarbons which are considered to be stratospherically safe substitutes for presently used fully halogenated chlorofluorocarbons. The latter are suspected of causing environmental problems in connection with the earth's protective ozone layer. Mathematical models have substantiated that hydrochlorofluorocarbons, such as 1,1-dichloro-1-fluoroethane (HCFC-141b), will not adversely affect atmospheric chemistry, being negligible contributors to ozone depletion and to green-house global warming in comparison to the fully halogenated species.

We are aware of only one disclosure of an azeotropic composition including 1,1-dichloro-1-fluoroethane, namely *Anon., Research Disclosures*, Vol. 162, p. 70 (1977) in which it is stated that n-pentane and iso-pentane form binary azeotropes with 1,1-dichloro-1-fluoroethane.

U.S. Pat. No. 3,936,387 discloses the azeotropic composition of methanol with 1,2-dichloro-1-fluoroethane, HCFC-141, which is an isomer of HCFC-141b. Similarly, U.S. Pat. No. 4,035,258 discloses the azeotropic composition of ethanol with 1,2-dichloro-1-fluoroethane. This information did not lead us to the azeotropic composition of the invention since, as is well known in this art, there is no published, reliable basis on which to predict azeotropy. Moreover, as is equally well known, the existence of an azeotropic composition does not enable one skilled in the art to predict azeotropy between or among related components. For example, U.S. Pat. No. 3,936,387 discloses that FC-141 and isopropanol form an azeotropic composition, whereas FC-141b and isopropanol do not form an azeotrope.

Nitromethane is a known stabilizer for preventing metal attack by chlorofluorocarbon mixtures containing alcohols. For example, U.S. Pat. No. 3,573,213 discloses an azeotropic mixture of 1,1,2-trichloro-1,2,2-trifluoroethane with nitromethane in which mixture nitromethane is stated to perform such stabilizing function.

L. Horsley, AZEOTROPIC DATA-III, 70 (1973) discloses azeotropic compositions of nitromethane and methanol or ethanol.

U.S. Pat. No. 4,816,174 discloses azeotropic compositions of 2,2-dichloro-1,1,1-trichloroethane (HCFC-123) or 1,2-dichloro-1,1,2-trifluoroethane (HCFC-123a), methanol, and nitromethane.

U.S. Pat. No. 4,816,175 discloses azeotropic compositions of HCFC-123 or HCFC-123a, methanol, nitromethane, and cyclopentane.

The use of the aerosol packaging concept has long been found to be a convenient and cost effective means of dispensing solvents. Aerosol products utilize a propellant gas or mixture of propellant gases, preferably in a liquified gas rather than a compressed gas state, to generate sufficient pressure to expel the active ingredients, i.e. product concentrates such as solvents, from the container upon opening of the aerosol valve. The propellants may be in direct contact with the solvent, as in most conventional aerosol systems, or may be isolated from the solvent, as in barrier-type aerosol systems.

It is an object of this invention to provide a method of cleaning by using novel azeotrope-like compositions based on HCFC-141b which are liquid at room temperature.

Other objects and advantages of the invention will become apparent from the following description.

DESCRIPTION OF THE INVENTION

In accordance with the invention, novel azeotrope-like compositions have been discovered comprising HCFC-141b, methanol, and nitromethane.

In a preferred embodiment of the invention, the azeotrope-like compositions comprise from about 93 to about 98 weight percent of HCFC-141b, from about 7 to about 2 weight percent methanol, and from about 0.1 to about 0.01 weight percent nitromethane.

In a still preferred embodiment of the invention, the azeotrope-like compositions comprise from about 95.0 to about 97.0 weight percent HCFC-141b, from about 5 to about 3 weight percent methanol, and from about 0.1 to about 0.01 weight percent nitromethane.

Our best estimate of the true azeotrope and our most preferred embodiment is about 96.0 weight percent FC-141b, about 3.9 weight percent methanol, and about 0.01 weight percent nitromethane, which exhibits a boiling point of about 29.4° C.±0.1° C. at 760 mm Hg.

All compositions within the above-identified ranges, as well as certain compositions outside the indicated ranges, are azeotrope-like, as defined more particularly below.

The precise or true azeotrope composition has not been determined but has been ascertained to be within the indicated ranges. Regardless of where the true azeotrope lies, all compositions within the indicated ranges, as well as certain compositions outside the indicated ranges, are azeotrope-like, as defined more Particularly below.

It has been found that these azeotrope-like compositions are on the whole nonflammable liquids, i.e. exhibit no flash point when tested by the Tag Open Cup test method - ASTM D 1310-86. The vapor phase, however, does exhibit a narrow range of flame limits (9.9–15.2 volume percent in air at ambient conditions).

From fundamental principles, the thermodynamic state of a fluid is defined by four variables: pressure, temperature, liquid composition and vapor composition, or P-T-X-Y, respectively. An azeotrope is a unique characteristic of a system of two or more components where X and Y are equal at the stated P and T. In practice, this means that the components of a mixture cannot be separated during distillation, and therefore in vapor phase solvent cleaning as described above.

For the purpose of this discussion, by azeotrope-like composition is intended to mean that the composition behaves like a true azeotrope in terms of its constant boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree.

Thus, one way to determine whether a candidate mixture is "azeotrope-like" within the meaning of this invention, is to distill a sample thereof under conditions (i.e. resolution - number of plates) which would be expected to separate the mixture into its separate components. If the mixture is non-azeotropic or non-azeotrope-like, the mixture will fractionate, i.e. separate into its various components with the lowest boiling component distilling off first, and so on. If the mixture is azeotrope-like, some finite amount of a first distillation cut will be obtained which contains all of the mixture components and which is constant boiling or behaves as a single substance. This phenomenon cannot occur if the mixture is not azeotrope-like i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above that another characteristic of azeotrope-like compositions is that there is a range of compositions containing the same components in varying proportions which are azeotrope-like. All such compositions are intended to be covered by the term azeotrope-like as used herein. As an example, it is well known that at differing pressures, the composition of a given azeotrope will vary at least slightly as does the boiling point of the composition. Thus, an azeotrope of A and B represents a unique type of relationship but with a variable composition depending on temperature and/or pressure. Accordingly, another way of defining azeotrope-like within the meaning of this invention is to state that such mixtures boil within about ±0.1° C. (at about 760 mm Hg) of the 29.4° C. boiling point of the most preferred composition disclosed herein. As is readily understood by persons skilled in the art, the boiling point of the azeotrope will vary with the pressure.

In the process embodiment of the invention, the azeotrope-like compositions of the invention may be used to clean solid surfaces by treating said surfaces with said compositions in any manner well known to the art such as by dipping or spraying or use of conventional degreasing apparatus.

The FC-141b, methanol, and nitromethane components of the novel solvent azeotrope-like compositions of the invention are known materials and are commercially available. Preferably they should be used in sufficiently high purity so as to avoid the introduction of adverse influences upon the solvency properties or constant boiling properties of the system.

In the present invention, the aforedescribed azeotrope-like compositions may be used to clean solid surfaces by spraying the surfaces with the compositions. Preferably, the azeotrope-like compositions are sprayed onto the surfaces by using a propellant. Preferably, the propellant is selected from the group consisting of hydrocarbons, chlorofluorocarbons, hydrochlorofluorocarbon, hydrofluorocarbon, dimethyl ether, carbon dioxide, nitrogen, nitrous oxide, methylene oxide, air, and mixtures thereof.

Useful hydrocarbon propellants include isobutane, butane, propane, and mixtures thereof; commercially available isobutane, butane, and propane may be used in the present invention. Useful chlorofluorocarbon propellants include trichlorofluoromethane (known in the art as CFC-11), dichlorodifluoromethane (known in the art as CFC-12), 1,1,2-trichloro-1,2,2-trifluoroethane (known in the art as CFC-113), and 1,2-dichloro-1,1,2,2-tetrafluoroethane (known in the art as CFC-114); commercially available CFC-11, CFC-12, CFC-113, and CFC-114 may be used in the present invention.

Useful hydrochlorofluorocarbon propellants include dichlorofluoromethane (known in the art as HCFC-21), chlorodifluoromethane (known in the art as HCFC-22), 1-chloro-1,2,2,2-tetrafluoroethane (known in the art as HCFC-124), 1,1-dichloro-2,2-difluoroethane (known in the art as HCFC-132a), 1-chloro-2,2,2-trifluoroethane (known in the art as HCFC-133), and 1-chloro-1,1-difluoroethane (known in the art as HCFC-142b); commercially available HCFC-21, HCFC-22, and HCFC-142b may be used in the present invention. HCFC-124 may be prepared by a known process such as that taught by U.S. Pat. No. 4,843,181 and HCFC-133 may be prepared by a known process such as that taught by U.S. Pat. No. 3,003,003.

Useful hydrofluorocarbon propellants include trifluoromethane (known in the art as HFC-23), 1,1,1,2-tetrafluoroethane (known in the art as HFC-134a), and 1,1-difluoroethane (known in the art as HFC-152a); commercially available HFC-23 and HFC-152a may be used in the present invention. Until HFC-134a becomes available in commercial quantities, HFC-134a may be made by a known method such as that disclosed by U.S. Pat. No. 4,851,595. More preferred propellants include hydrochlorofluorocarbons, hydrofluorocarbons, and mixtures thereof. The most preferred propellants include chlorodifluoromethane and 1,1,1,2-tetrafluoroethane.

The present invention is more fully illustrated by the following non-limiting Examples.

EXAMPLE 1

This example confirms the existence of the azeotrope between 1,1-dichloro-1-fluoroethane, methanol, and nitromethane.

A 5-plate Oldershaw distillation column with a cold water condensed automatic liquid dividing head was used for this example. The distillation column was charged with a three component blend consisting of 3.8 weight percent methanol. 96.0 weight Percent 1,1,-dichloro- -1-fluoroethane and 0.Z weight percent nitromethane which was heated under total reflux for about an hour to ensure equilibration. A reflux ratio of 5:1 was employed. Approximately 40 percent of the original charge was collected in five similar-sized overhead fractions. The compositions of these fractions, in addition to the composition of the liquid residue, were analyzed using gas chromatography. The Table shows that the compositions of the starting material, the five distillate fractions and the liquid residue are identical, within the uncertainty associated with determining the compositions, indicating that the mixture is an azeotrope.

TABLE

| | Methanol | FC-14 lb | Nitromethane |
|---|---|---|---|
| Starting Material (wt. %) | 3.8 | 96.0 | 0.2 |
| Constant Boiling Fractions (wt. %) | 3.9 | 96.0 | 0.01 |
| Vapor Temperature (°C.) | 28.6 | | |
| Barometric Pressure (mm Hg) | 740.9 | | |
| Vapor Temperature (°C.) (corrected to 760 mm Hg) | 29.4 | | |

EXAMPLE 2

For the following example, a six-ounce three-piece aerosol can is used. The azeotrope-like blend of Example 1 is weighed into the tared aerosol can. After purging the can with tetrafluoroethane in order to displace the air within the container, a valve is mechanically crimped onto the can. Liquid chlorodifluoromethane is then added through the valve utilizing pressure burettes.

A printed circuit board having an area of 37.95 square inches and densely populated with dip sockets, resistors, and capacitors is precleaned by rinsing with isopropanol before wave soldering. The board is then fluxed and wave soldered using a Hollis TDL wave solder machine.

The printed circuit board is then spray cleaned using the aerosol can having the azeotrope-like composition therein. The cleanliness of the board is tested visually and also using an Omega-meter which measured the ionic contamination of the board.

Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: epoxy compounds such as propylene oxide; nitroalkanes such as nitroethane; ethers such as 1-4-dioxane; unsaturated compounds such as 1,4-butyne diol; acetals or ketals such as dipropoxy methane; ketones such as methyl ethyl ketone; alcohols such as tertiary amyl alcohol; esters such as triphenyl phosphite; and amines such as triethyl amine. Other suitable inhibitors will readily occur to those skilled in the art.

Having described the invention in detail and by reference to preferred embodiments thereof, it will be apparent that modifications and variations are possible without departing from the scope of the invention defined in the appended claims.

What is claimed is:

1. A method of cleaning a solid surface which comprises spraying said surface with azeotrope-like compositions comprising from about 93.0 to about 98.0 weight percent 1,1-dichloro-1-fluoroethane, from about 7 to about 2 weight percent methanol, and from about 0.1 to about 0.01 weight percent nitromethane by using a propellant.

2. The method of claim 1 wherein said propellant is selected from the group consisting of hydrochlorofluorocarbon, hydrofluorocarbon, and mixtures thereof.

3. The method of claim 2 wherein said propellant is hydrochlorofluorocarbon.

4. The method of claim 3 wherein said hydrofluorocarbon is chlorodifluoromethane.

5. The method of claim 2 wherein said propellant is hydrofluorocarbon.

6. The method of claim 5 wherein said hydrofluorocarbon is 1,1,1,2-tetrafluoroethane.

7. The method of claim 1 wherein said azeotrope-like compositions comprise from about 95.0 to about 97.0 weight percent said 1,1-dichloro-1-fluoroethane, from about 5 to about 3 weight percent said methanol, and from about 0.1 to about 0.1 weight percent said nitromethane.

8. The method of claim 1 wherein said azeotrope-like compositions comprise about 96.0 weight percent said 1,1-dichloro-1-fluoroethane, about 3.9 weight percent said methanol, and about 0.01 weight percent said nitromethane.

* * * * *